United States Patent [19]

Brummer et al.

[11] 4,359,059

[45] Nov. 16, 1982

[54] PROCESS FOR THE PREPARATION OF AROMATIC SUBSTANCES

[75] Inventors: Ursula Brummer, Halstenbek; Volker Heemann, Reinbek, both of Fed. Rep. of Germany

[73] Assignee: B.A.T. Cigaretten-Fabriken GmbH, Hamburg, Fed. Rep. of Germany

[21] Appl. No.: 240,854

[22] Filed: Mar. 5, 1981

[30] Foreign Application Priority Data

Mar. 8, 1980 [DE] Fed. Rep. of Germany ..... 3009032

[51] Int. Cl.[3] ..... A24C 3/12; A24C 15/30

[52] U.S. Cl. ..... 131/276; 131/299; 131/298; 131/309

[58] Field of Search ..... 131/274–279, 131/297, 290, 299, 309, 356

[56] References Cited

FOREIGN PATENT DOCUMENTS 1206210 2/1960 France .
1316172 3/1970 United Kingdom .

OTHER PUBLICATIONS

Agric. Biol. Chem. 44(3), 705–706, 1980.

*Primary Examiner*—V. Millin
*Attorney, Agent, or Firm*—Arnold, White & Durkee

[57] ABSTRACT

Aromatic substances to be applied to tobacco to improve aroma characteristics are prepared by exposing an alcoholic extract, which contains diterpenes and has been isolated from the surface resin of fresh tobacco plants, parts or from gum originating from tobacco flowers, to ultraviolet light and oxygen.

8 Claims, No Drawings

PROCESS FOR THE PREPARATION OF AROMATIC SUBSTANCES

BACKGROUND OF THE INVENTION

The present invention relates to a process for the preparation of aromatic substances by ultraviolet (UV) irradiation in the presence of oxygen of an alcoholic extract which contains diterpenes and has been obtained from the surface resin of fresh tobacco plants or parts thereof or from the gum originating from tobacco flowers.

As is known, the surface resin of fresh tobacco plants contains diterpenes, in particular duvanes, which, as smoke aroma precursors, influence the tobacco aroma. Numerous processes for isolating these diterpenes from the surface resin are known, and with these processes undersired constituents, in particular, lipids, which are likewise present in the resin are separated off. The process at this type is disclosed, for example, in German Offenlegungsschrift No. 2,918,920.

After isolation and purification, the diterpene fraction obtained in this way is added to conditioned tobacco (tobacco which has been processed ready for use).

In the past, the properties of diterpenes, isolated from tobacco plants, as smoke aroma precursors have induced several workers in the field to concern themselves with clarification of the chemical structure of the diterpenes and their chemical reactions, in particular with regard to their photoreactions with a singlet oxygen. Cf. Acta Chemica Scandinavica 1979, pp. 437–442. In these investigations, the photo oxidation was carried out in the presence of sensitizers, for example, Rose Bengal. The oxidation involves absorption of UV light by the sensitizer which undergoes an electronic transition to the excited singlet state. Singlet oxygen than reacts with the diterpenes to give the oxidized product.

SUMMARY OF THE INVENTION

The process of the present invention allows the production of aromatic substances from a diterpene containing alcoholic extract from tobacco plant material by exposing the extract to a source of oxygen and a source of ultraviolet light in the absence of sensitizers. The aromatic substances thus produced may then be applied to conditioned tobacco to achieve an improvement in the tobacco aroma. Additionally, if desired, the aromatic substances may be fractionated prior to application to the conditioned tobacco.

DETAILED DESCRIPTION OF THE PREFERRED EMBODIMENT

As previously mentioned, it has now been found that a considerably improved tobacco aroma can be obtained from a diterpene fraction of the above-mentioned type if the alcoholic diterpene extract is irradiated, that is to say subjected to a photo oxidation, in the absence of sensitizers. As a result of the absence of sensitizers, the photo oxidation of the diterpenes no longer takes place by means of singlet oxygen but, rather by a conventional free radical mechanism. Accordingly, the aromatic substances obtained by the process of the invention contain, as an initial analysis has shown, products which have numerous free carboxyl groups in a constitution which in other respects is unknown.

The improvements in flavor, which are achieved with the diterpene extract treated according to the invention, and in the aroma of the tobacco obtained using the irradiated extract are surprising since, under the process conditions, it would have been assumed that the destruction of the aromatic substances would be considerably more extensive than in the case of photo oxidation with singlet oxygen.

The starting materials used for isolation of the alcoholic diterpene fraction are Nicotinia species such as N. tomentosiformis, glutinosa or sylvestris, or known tobacco hybrids, and also tobacco plants from conventional tobacco crops. In particular, it is possible to use those species of tobacco which in themselves are not suitable as smoking tobacco but which form large amounts of surface resin. The tobacco plants which in other respects are unsuitable can then be discarded after the diterpenes have been separated off. Furthermore, tobacco flowers can be employed to prepare the diterpene fraction.

Solvents which can be employed for the diterpene fraction to be irradiated are lower alcohols, especially methanol and ethanol. The irradiated extracts can, optionally after prior concentration, be applied directly, for example by spraying, to conditioned tobacco.

Preferably, the photo oxidation is effected by passing a stream of air or oxygen through the extract and, at the same time irradiating the later using a suitable source of UV light, which supplies a wavelength of 220–580 nm.

Conventional UV lamps, for example high pressure mercury vapor lamps or the like, can be used for the irradiation. The photo oxidation according to the invention can be carried out at room temperature, but other temperatures are also possible, for example temperatures between −20° C. and the boiling point of the solvent used. The duration of the irradiation depends on the size of the batch for irradiation, on the particular type of diterpenes, which can vary depending on the tobacco plants, and on the power of the source of UV light. It is in general one hour to ten days and in particular six to twenty-four hours.

According to a further advantageous embodiment of the invention, the irradiated extract is fractionated before it is applied to the tobacco. By this means it is possible to separate off undesired byproducts, for example highly volatile constitutents and polymers, which have an adverse effect on the aroma or are not able to contribute anything to its improvement.

The above-mentioned fractionation can be carried out in various ways. One suitable method is column chromatography, for example on silica gel. For this purpose the irradiated solution is concentrated and introduced into a silica gel column. Elution is then carried out with various solvents of increasing polarity. For example, hexane can be used as the first eluant; this eluant, which contains nonpolar hydrocarbons, is discarded. Elution with ether is then carried out; this elute is collected. Finally, the valuable carboxylic acids formed during the irradiation can be isolated and collected by elution with methanol to which, optionally, a small amount, for example 1% of acetic acid has been added. The ether eluates and methanol eluates are then concentrated in vacuo; the residue can be taken up in another solvent and then applied to the tobacco.

A further fractionation method is distillation. Concentration of the methanol extract at room temperature in vacuo already results in removal of undesired low boiling constituents. The residue can then be subjected to distillation under a high vacuum and, in a typical case, the distillate which, under 0.02 mm Hg, passes over at a temperature of up to 100° C. is collected and used as an aromatic substance.

Finally, the resins obtained after removal of the methanol can also be subjected to a steam distillation, in which case the steam-volatile products are collected and employed as aromatic substances.

In the text which follows, the process of the invention is illustrated in more detail with the aid of a preferred illustrative example.

Preparation of an Alcoholic Diterpene Fraction

Parts of fresh green tobacco plants, namely stems, flowers and leaves, are washed for 30 seconds with methylene chloride in an amount of 1 l./kg. of tobacco parts. This wash step is then repeated a second time. The subsequent separation of the diterpenes from accompanying substances originating from the methylene chloride fraction is effected in a conventional manner by chromatography on silica gel or by phase partitioning .

Methanol is added to the diterpene fraction thus obtained, in an amount such that a solution with a concentration of 1–100 g. of solid/l. of methanol is obtained.

Photo Oxidation

Three hundred milliliters of an extract obtained as indicated above are introduced into a 500 ml. reactor and irradiated using a high pressure mercury lamp (Phillips High Pressure Lamp HPK 125) for 10 hours at room temperature, while stirring. A continuous stream of synthesis air is bubbled through the solution during the reaction.

Fractionation of the Irradiated Extract

The irradiated extract obtained above is concentrated to a small volume and introduced into a column filled with silica gel (dimensions: 2.5×50 cm). The column is then eluted with hexane; the resulting hexane fraction is discarded. The column is then eluted with ether and finally with methanol to which 1% of acetic acid has been added. The eluates obtained here are collected and evaporated in vacuo at room temperature. The residue is taken up in ethanol and sprayed onto conditioned tobacco and the solvent is then allowed to evaporate.

Modifications and variations of the invention will be apparent to those skilled in the art. It is the applicant's intention in the following claims to cover all such equivalent modifications and variations as fall within the true spirit and scope of the invention.

What is claimed is:

1. A process for the preparation of aromatic substances from a diterpene containing alcoholic extract from tobacco plant material, which comprises exposing said extract to a source of oxygen and a source of ultraviolet light in the absence of sensitizers.

2. The process of claim 1 wherein said ultraviolet source is of the wavelength of 220–580 nm.

3. The process of claim 2 wherein the exposure to ultraviolet light is carried out at room temperature.

4. The process of claim 3 wherein the exposure to ultraviolet light is carried out for a period between about 1 hour and 10 days.

5. The process according to claim 4, which further comprises fractionating the extract after exposure.

6. The process of claim 1, wherein the exposure to ultraviolet light is carried out for a period of between about 6–24 hours.

7. The process of claim 1 in which the diterpene containing alcohol extract is an extract obtained from the surface resin of fresh tobacco plants, parts or from the gum originating from tobacco flowers.

8. A method for the production of tobacco with enhanced aromatic properties which comprises applying the product of the process of claim 1 or claim 5 to condition tobacco.

* * * * *